US006761259B1

(12) United States Patent
Onodera et al.

(10) Patent No.: US 6,761,259 B1
(45) Date of Patent: Jul. 13, 2004

(54) MOVING HANDRAIL FOR PASSENGER CONVEYOR

(75) Inventors: Tsuyoshi Onodera, Tokyo (JP); Muneaki Mukuda, Tokyo (JP); Kohsuke Haraga, Tokyo (JP); Ryuji Otsuka, Chiba (JP); Yuji Kawamura, Chiba (JP)

(73) Assignees: Mitsubishi Denki Kabushiki Kaisha, Tokyo (JP); Kabushikikaisha Tokan, Matsudo (JP)

( * ) Notice: Subject to any disclaimer, the term of this patent is extended or adjusted under 35 U.S.C. 154(b) by 0 days.

(21) Appl. No.: 10/643,948

(22) Filed: Aug. 20, 2003

(30) Foreign Application Priority Data

Jan. 22, 2003 (JP) ..... 2003-013867

(51) Int. Cl.[7] ..... B66B 23/24
(52) U.S. Cl. ..... 198/335; 198/337
(58) Field of Search ..... 198/335, 337, 198/957, 847; 156/304.2, 304.5, 304.6

(56) References Cited

U.S. PATENT DOCUMENTS 3,568,813 A * 3/1971 Schaeffer et al. ..... 198/335
3,740,799 A * 6/1973 Earle ..... 24/33 B
3,778,882 A * 12/1973 Cameron et al. ..... 29/450
3,989,133 A * 11/1976 Courson et al. ..... 198/335
4,005,773 A * 2/1977 Bouille ..... 198/335
4,159,758 A * 7/1979 Courson ..... 198/335
4,488,631 A * 12/1984 Courson ..... 198/335
4,618,387 A * 10/1986 Fisher et al. ..... 156/244.11
5,255,772 A * 10/1993 Ball et al. ..... 198/337
5,275,270 A * 1/1994 Dobo ..... 198/337
5,736,225 A * 4/1998 Nagy ..... 428/167
6,086,806 A 7/2000 Weatherall et al.
6,237,740 B1 * 5/2001 Weatherall et al. ..... 198/337
6,497,318 B2 * 12/2002 Schulte et al. ..... 198/337

FOREIGN PATENT DOCUMENTS

JP 2000-211872 8/2000

* cited by examiner

*Primary Examiner*—Douglas Hess
(74) *Attorney, Agent, or Firm*—Leydig, Voit & Mayer, Ltd.

(57) ABSTRACT

A moving handrail superior in durability includes a linear belt of which two end portions are connected, forming a loop. This linear belt includes a single-layer or multilayer of thermoplastic elastomer having a C-shape in cross section; metallic and web-shaped metal stretch inhibitors disposed along a longitudinal direction of the thermoplastic elastomer, and base members coupled inside of the thermoplastic elastomer. The thermoplastic elastomer, metal stretch inhibitor, and base member are integrally molded. In the connection portion, a splice junction between the metal stretch inhibitors and a joint where the base members are connected together at both end portions with an auxiliary backing does not overlap in a direction of thickness of the moving handrail. Further, the metal stretch inhibitors that are spliced are enclosed with a thermoplastic elastomer.

8 Claims, 5 Drawing Sheets

MOVING HANDRAIL FOR PASSENGER CONVEYOR

BACKGROUND OF THE INVENTION

1. Field of the Invention

The present invention relates to a structure of a moving handrail for use in a passenger conveyor.

2. Description of the Related Art

For connection of a thermoplastic elastomer article such as escalator handrail that includes a large number of reinforcing cables or a slider knit, two ends of the article are cut along with the existing reinforcing cable to form patterns engaging with each other, and both ends are brought into engagement. Thereafter, the end portions are placed in a mold together with a resin sheet to be an outer layer and a slider knit, which have been preliminarily made, and press-molded to complete a connection article. This connection product is disclosed in the International Patent Publication No. WO 97/37834.

However, in the connection article without connection between the reinforcing cables as described above, there is a possibility that any breakage that occurs will occur at a joint portion therebetween. It is further possible that the joint portion of the article is stretched during moving, thereby causing any change in dimensions due to the use of thermoplastic elastomer.

The invention has an object of providing a moving handrail for a passenger conveyor including a metal stretch inhibitor and connecting metal stretch inhibitors to each other by an adhesive or welding, in which a joint portion of the moving handrail is prevented from being stretched. The invention has a further object of providing a moving handrail in which durability of the joint portion is further improved.

SUMMARY OF THE INVENTION

To accomplish the foregoing objects, a moving handrail for a passenger conveyor according to the present invention includes a linear belt of which two end portions are connected forming a loop. This linear belt is composed of: a single-layer or multilayer of thermoplastic elastomer of C-shape in cross section; metallic and web-shaped metal stretch inhibitors disposed along a longitudinal direction of the thermoplastic elastomer; and base members coupled inside of the mentioned thermoplastic elastomer. The mentioned thermoplastic elastomer, metal stretch inhibitor and base member are integrally molded. In the mentioned connection portion of the mentioned moving handrail for a passenger conveyor, a splice junction between the mentioned metal stretch inhibitors and a joint where the base members are connected together at both end portions with the use of an auxiliary backing are disposed so as not to overlap in a direction of thickness of the moving handrail. Further, the mentioned metal stretch inhibitors having been spliced are enclosed with a thermoplastic elastomer.

Another moving handrail for a passenger conveyor according to the invention also includes a linear belt of which two end portions are connected forming a loop. This linear belt is also composed of: a single-layer or multilayer of thermoplastic elastomer of C-shape in cross section; metallic and web-shaped metal stretch inhibitors disposed along a longitudinal direction of the thermoplastic elastomer; and base members coupled inside of the mentioned thermoplastic elastomer. The mentioned thermoplastic elastomer, metal stretch inhibitor and base member are integrally molded. In the mentioned connection portion of the mentioned moving handrail for a passenger conveyor, both end portions of the mentioned metal stretch inhibitors of the mentioned connection portion are overlapped and spliced together so as to sandwich a buffer layer composed of both or either one of a thermoplastic resin sheet and a thermosetting rein sheet, otherwise via a buffer layer directly applied with a liquid resin. Further, the mentioned metal stretch inhibitors having been spliced are enclosed with a thermoplastic elastomer.

A further moving handrail for a passenger conveyor according to the invention also includes a linear belt of which two end portions are connected forming a loop. This linear belt is composed of: an inner layer thermoplastic elastomer of C-shape in cross section; an outer layer thermoplastic elastomer of an elastic modulus different from that of said inner layer thermoplastic elastomer; metallic and web-shaped metal stretch inhibitors disposed along a longitudinal direction of the thermoplastic elastomer; and base members coupled inside of the mentioned thermoplastic elastomers. The mentioned inner and outer thermoplastic elastomers, metal stretch inhibitor and base member are integrally molded. The mentioned connection portion of the mentioned moving handrail for a passenger conveyor includes: a splice junction between the mentioned metal stretch inhibitors; a joint where the base members are connected together with the use of an auxiliary backing at both end portions; and a butt joint where the mentioned inner layer thermoplastic elastomer is brought into an abutting relation at both ends that are formed into a straight line inclined at an angle of more than 0° to less than 90° with respect to a longitudinal direction, or a curved line. Further, the mentioned splice junction between the metal stretch inhibitors and the mentioned butt joint between the ends of the inner layer thermoplastic elastomer are covered with the outer layer thermoplastic elastomer.

A still further moving handrail for a passenger conveyor according to the invention also includes a linear belt of which two end portions are connected forming a loop. This linear belt is composed of: a single-layer or multilayer of thermoplastic elastomer of C-shape in cross section; metallic and web-shaped metal stretch inhibitors disposed along a longitudinal direction of the thermoplastic elastomer; and base members coupled inside of the mentioned thermoplastic elastomer. The mentioned thermoplastic elastomer, metal stretch inhibitor and base member are integrally molded. The mentioned connection portion of the mentioned moving handrail for a passenger conveyor includes: a splice junction between the mentioned metal stretch inhibitors; and a joint where both ends of the base member are formed into a straight line inclined at an angle of more than 0° to less than 90° with respect to a longitudinal direction or a curved line and connected together with the use of an auxiliary backing overlapped therewith in the same overlapping width. Further, the mentioned splice junction between the metal stretch inhibitors is covered with the thermoplastic elastomer.

A yet further moving handrail for a passenger conveyor according to the invention also includes a linear belt of which two end portions are connected forming a loop. This linear belt is composed of: a single-layer or multilayer of thermoplastic elastomer of C-shape in cross section; metallic and web-shaped metal stretch inhibitors disposed along a longitudinal direction of the thermoplastic elastomer; and base members coupled inside of the mentioned thermoplastic elastomer. The mentioned thermoplastic elastomer, metal stretch inhibitor and base member are integrally molded. The mentioned connection portion of the mentioned moving handrail for a passenger conveyor includes: a splice junction where the mentioned metal stretch inhibitors are overlapped and spliced so that both end portions having been formed into a straight line inclined at an angle of more than 0° to less than 90° with respect to a longitudinal direction or a curved line may be overlapped in the same width, and a joint where the base members at both end portions are connected together with the use of an auxiliary backing. Further, the mentioned splice junction between the metal stretch inhibitors is covered with the thermoplastic elastomer.

Although the moving handrail is often bent, but bending takes place in such a bend direction that an opening side of C-shape in cross section may come primarily to inside. A tensile force exerts on a ridgeline (edge line) portion of the moving handrail due to bending, however, as described above, it is arranged such that all the joints are not completely in conformity with the ridgeline. As a result, increase in rigidity is dispersed, and the likelihood of a stress concentration is reduced, thereby enabling to improve durability at the moving handrail connection portion.

The other objects and features of the present invention will become understood from the following description with reference to the accompanying drawings.

DETAILED DESCRIPTION OF THE PREFERRED EMBODIMENTS

Embodiment 1

Figure 1:
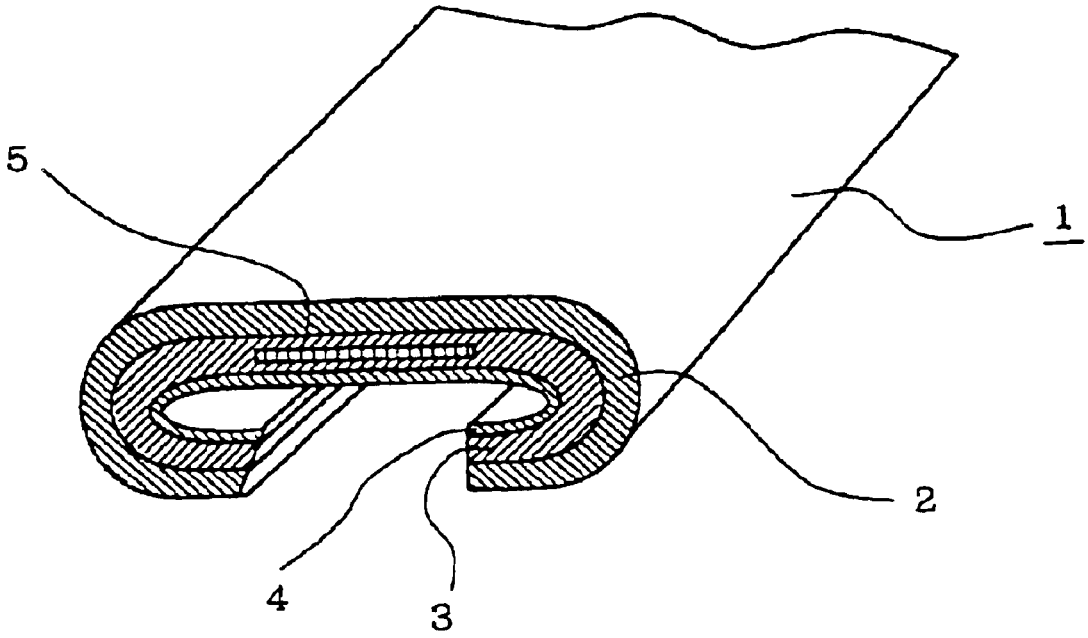
FIG. 1 is a cross sectional perspective view of a moving handrail for a passenger conveyor according to the present invention.
Figure 2:
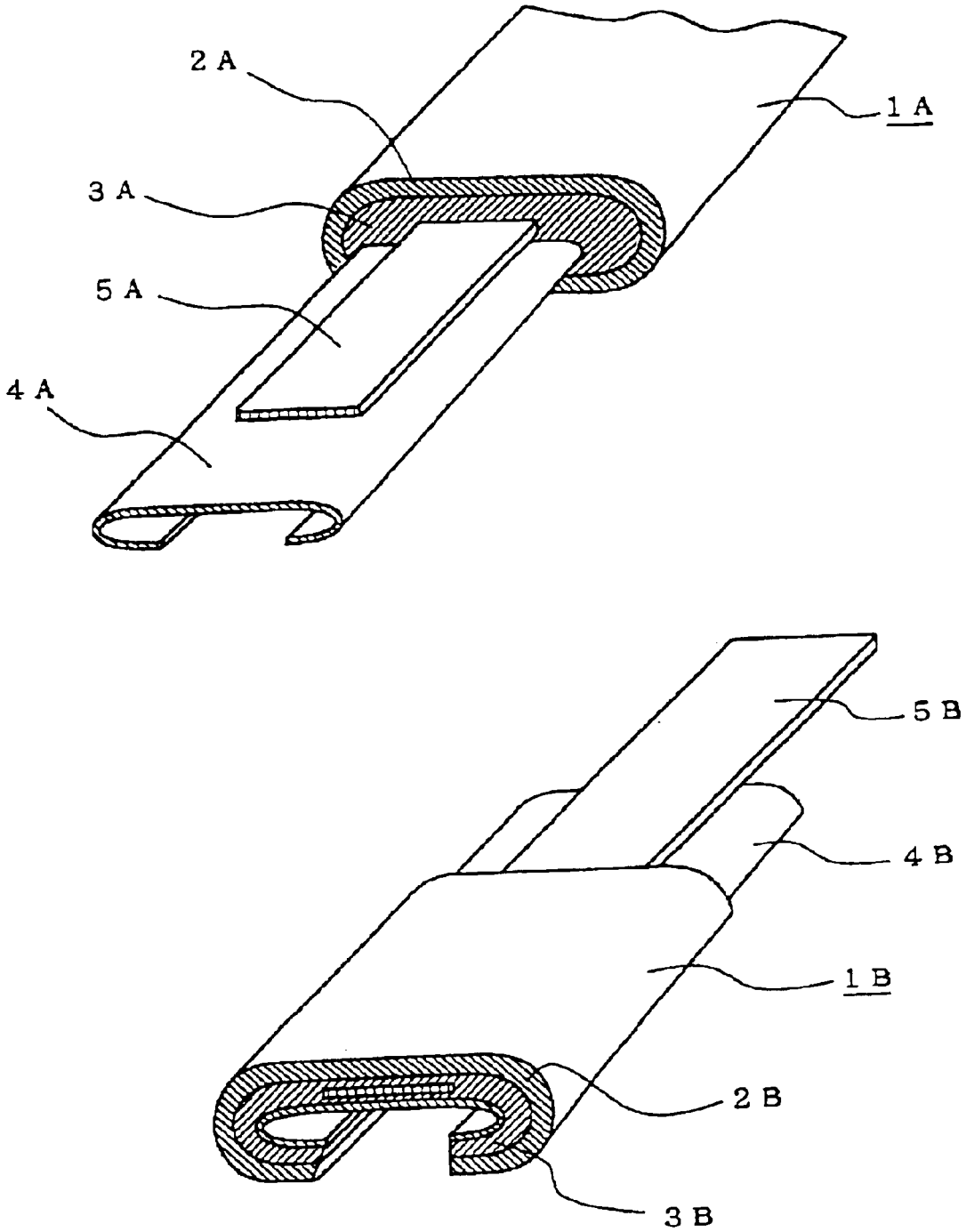
FIG. 2 is a perspective view showing a manufacturing process of a moving handrail for a passenger conveyor according to a first preferred embodiment of the invention.
Figure 3:
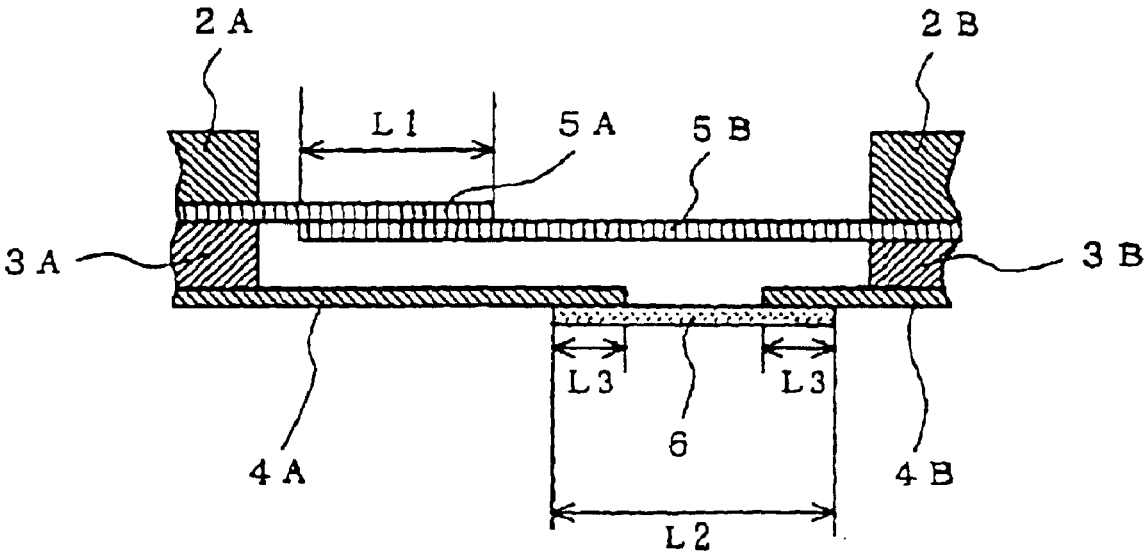
FIG. 3 is a cross sectional side view showing a manufacturing process of the moving handrail for a passenger conveyor according to the first embodiment.

FIG. 1 is a perspective view showing a cross section of a moving handrail according to the present invention, FIG. 2 is a perspective view showing a state before connection between moving handrail belt end portions explaining a first preferred embodiment of the invention, and FIG. 3 is a cross sectional side view showing a state on the way of connecting the end portions. As shown in FIG. 1, a moving handrail 1 is composed of an outer layer thermoplastic elastomer 2 and an inner layer thermoplastic elastomer 3 of an elastic modulus different from that of the outer thermoplastic elastomer 2, the elastomers 2, 3 integrally forming a C-shape in cross section, and a canvas 4 to serve as a base member disposed on an internal surface of the C-shape. Further, a metal stretch inhibitor 5, which is made of a web-shaped metal, is buried along a longitudinal direction of the moving handrail within the inner layer thermoplastic elastomer 3.

To connect an end portion 1A and an end portion 1B of such moving handrail belt, as shown in FIG. 2, first the outer layer thermoplastic elastomers 2A, 2B and the inner layer thermoplastic elastomers 3A, 3B of the end portions 1A, 1B are removed to expose the canvas 4A, 4B and the stretch inhibitors 5A, 5B. At this time, at the end portion 1A, the stretch inhibitor 5A is exposed so as to be shorter than exposure length of the canvas 4A. On the other hand, at the end portion 1B, the stretch inhibitor 5B is exposed so as to be longer than exposure length of the canvas 4B.

To connect the both end portions 1A, 1B, as shown in FIG. 3 illustrating a connection process on the way, the exposed metal stretch inhibitors 5A, 5B of both end portions 1A, 1B are overlapped and spliced by spot welding. Splicing between the metal stretch inhibitors 5A, 5B is not limited to be conducted by spot welding, but may be also conducted using an adhesive. Further, a patch 6 to be an auxiliary backing is overlapped on the canvases 4A and 4B in an overlap width L3 of approximately 10 mm, and bonded to the canvases 4A, 4B using the adhesive. At this time, dimensions of exposure of the canvas and stretch inhibitor at respective end portions are established in the above-described process of removing the thermoplastic elastomer so that an overlap L1 between the metal stretch inhibitors 5A and 5B and a part L2 including the overlaps between the canvass 4A, 4B and the patch 6 may not be overlapped in a direction of thickness of the moving handrail.

After the metal stretch inhibitors 5A, 5B are spliced together, and after bonding the patch 6 to the canvasses 4A, 4B, the end portions of the moving handrail 1A, 1B are placed within a mold, and molded with a thermoplastic elastomer by a publicly known method such as injection molding or press molding, thus completing an integrally formed moving handrail belt.

This first embodiment, as described above, is characterized in that the overlap splice between the metal stretch inhibitors 5A, 5B, and the part including the overlaps between the canvas 4A, 4B and patch 6 are staggered in position so as not to be overlapped in a direction of thickness of the moving handrail. In general, although the moving handrail is frequently bent, bending takes place in such a bend direction that an opening side of the C-shaped cross section may come primarily to inside. At this time, it is certain that a tensile force acts on an ridge line portion of the moving handrail, but since the overlaps at a connection portion are staggered in position as described above, increase in rigidity due to overlapping is dispersed, and the likelihood of a stress concentration is reduced. Consequently, durability at the moving handrail connection portion is improved.

Table 1 shows results of evaluating dependency indicated by number of repetition of bending upon overlap between the splice junction of the metal stretch inhibitors and the patch in a bending test of the moving handrail according to the first embodiment.

TABLE 1

| Dependency indicated by number of repetition in the bending test upon overlap between the splice junction of the metal stretch inhibitors and the patch | | |
|---|---|---|
| Present or absent of overlap | present | absent |
| Number of repetition (times) | 100000 | Not less than 10000000 |

Embodiment 2

Figure 4:
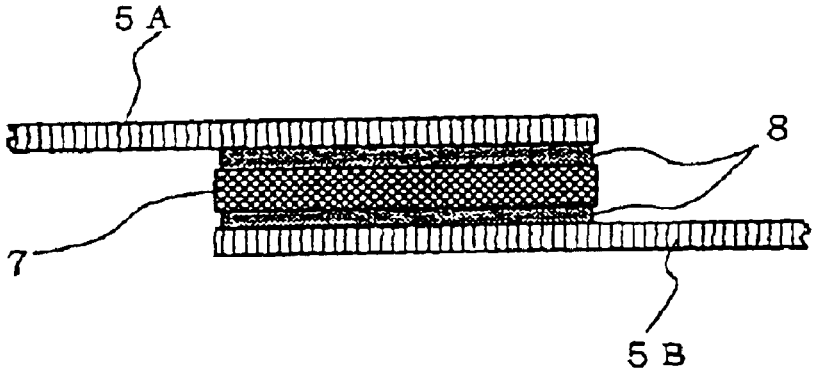
FIG. 4 is a cross sectional plan view showing a manufacturing process of a moving handrail for a passenger conveyor according to a second preferred embodiment of the invention.

FIG. 4 is a schematic view of a moving handrail end portion under manufacturing process to-explain a second preferred embodiment of the invention. According to this second embodiment, at the time of connecting the moving handrail end portions together, the metal stretch inhibitors 5A, 5B are exposed at both end portions 1A, 1B from a thermoplastic elastomer as shown in FIG. 2, and an adhesive 8 is to surfaces of the metal stretch inhibitors 5A, 5B, and a thermoplastic polyurethane sheet 7 is sandwiched between them to serve as a buffer. Thus, the metal stretch inhibitors 5A and 5B and the thermoplastic polyurethane sheet 7 are overlapped and adhesive-bonded together. Thereafter, the canvas and patch are also overlapped so that the overlap may be 10 mm in width, and both end portions of the moving handrail are placed in a mold and molded by a publicly known method such as injection molding or press molding.

According to such a construction, when the above-mentioned moving handrail is installed at a passenger conveyor such as escalator and operated, a buffer layer performs stress-absorbing function, thereby enabling to obtain a moving handrail superior in durability without abrasion and separation between the metal stretch inhibitors. The above-mentioned buffer layer is not limited to a thermoplastic sheet, but any other thermosetting sheet, a laminate of the thermoplastic sheet and thermosetting sheet, or a mere application of a liquid resin without the use of sheet and bonding it to serve as a buffer layer, may be preferably employed. Combination of the adhesive and resin sheet can be employed as far as a breaking force between the metal stretch inhibitors may be not less than 10N, and any combination capable of obtaining a breaking force of not less than 1KN is preferably employed. Table 2 shows results of evaluating a buffer dependency indicated by number of times of repetition in a bending test of the moving handrail according to this second embodiment.

TABLE 2

| Buffer dependency indicated by number of repetition in the bending test | | |
|---|---|---|
| Present or absent of buffer | present | absent |
| Number of repetition (times) | 200000 | Not less than 10000000 |

Embodiment 3

Figure 5:
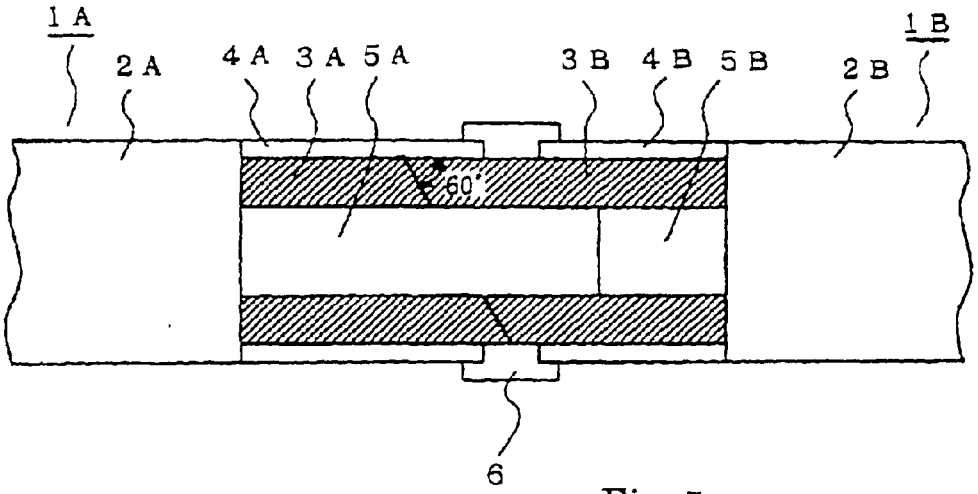
FIG. 5 is a cross sectional plan view showing a manufacturing process of a moving handrail for a passenger conveyor according to a third preferred embodiment of the invention.

FIG. 5 is a schematic view of a moving handrail end portion under manufacturing process to explain a third preferred embodiment of the invention. A connection procedure of a moving handrail end portion according to this third embodiment is described. First, the outer layer thermoplastic elastomers 2A, 2B are removed from the moving handrail end portions 1A and 1B, and subsequently the inner layer thermoplastic elastomers 3A, 3B are removed at the upper side above the metal stretch inhibitors 5A, 5B to expose the metal stretch inhibitors 5A, 5B. Further, the inner layer thermoplastic elastomers 3A, 3B are cut off so that cutting-plane line may be inclined at an angle of more than 0° to less than 90°, for example, at an angle of 60° with respect to a longitudinal direction. This angle is not limited to 60°, but needs only to be inclined with respect to a longitudinal direction, and further it does not matter whether a straight line or curved line. Then, as shown in FIG. 5, the metal stretch inhibitors 5A, 5B are bonded with an adhesive to each other, and the canvases 4A and 4B are connected through the patch 6 in a state that the cut sections of the inner layer thermoplastic elastomers 3A, 3B at the end portions 1A, 1B are abutting. Finally, the end portions of the moving handrail 1A, 1B are placed in the mold, and molded with a thermoplastic elastomer by a publicly known method such as injection molding or press molding thereby completing an integrally formed moving handrail belt.

In this third embodiment, the connection end portions of the inner layer thermoplastic elastomer of the moving handrail for use in a passenger conveyor are inclined and abutted. As a result, a moving handrail ridge line, where a tensile deformation or a compression deformation applied to the moving handrail at the time of operation of the escalator becomes the maximum, and the cut surfaces of the inner layer thermoplastic elastomer are crossed over, which results in reduction in stress concentration. Consequently, the moving handrail connection portion can be improved in durability. Table 3 shows results of evaluating a butt angle dependency indicated by number of times of repetition in a bending test of the moving handrail according to this third embodiment. In addition, combination of construction of the third embodiment with those described in the foregoing first and second embodiments can provide a further improvement in durability.

TABLE 3

| Dependency indicated by number of repetition in bending test upon a butt angle of the inner layer thermoplastic elastomer | | |
|---|---|---|
| Butt angle (degrees) | 90 | 60 |
| Number of repetition (times) | 30000 | Not less than 10000000 |

Embodiment 4

Figure 6:
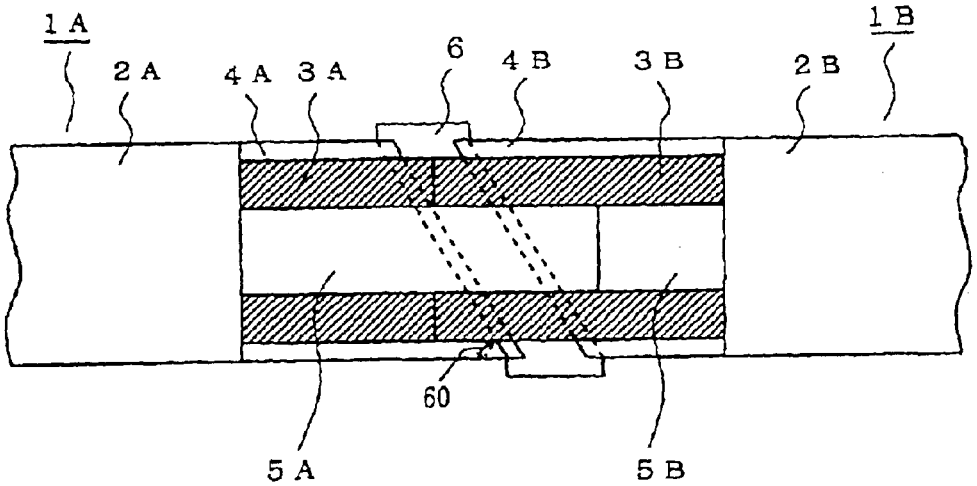
FIG. 6 is a cross sectional plan view showing a manufacturing process of a moving handrail for a passenger conveyor according to a fourth preferred embodiment of the invention.

FIG. 6 is a schematic view of a moving handrail end portion under manufacturing process to explain a fourth preferred embodiment according to the invention. A connection procedure between the moving handrail end portions according to the fourth embodiment is described. First, the outer layer thermoplastic elastomers 2A, 2B are removed from the end portions 1A, 1B, and subsequently the inner layer thermoplastic elastomers 3A, 3B are removed at the upper side above the metal stretch inhibitors 5A, 5B to expose the metal stretch inhibitors 5A, 5B. Then, end portions of the canvas 4A, 4B are cut off so that cutting-plane line may be inclined at an angle of more than 0° to less than 90°, for example, at an angle of 60° with respect to a longitudinal direction. Thus, a gap is made between the end portions of the canvas 4A, 4B at such a position that the end portions 1A, 1B may be confronted.

At the moving handrail end portions 1A, 1B having been manufactured as mentioned above, as shown in FIG. 6, the metal stretch inhibitors 5A, 5B are overlapped and bonded with the use of an adhesive in a state that cutting-planes of the inner layer thermoplastic elastomer 3A, 3B are abutting. Thereafter, a patch 6 is overlapped on the end portions of the canvas 4A, 4B in the same overlap width, for example, 10 mm, and bonded them together using an adhesive. Finally, the end portions 1A, 1B of the moving handrail are placed in the mold, and molded with a thermoplastic elastomer by a publicly known method such as injection molding or press molding thereby completing an integral moving handrail belt. It is also preferable that the metal stretch inhibitors 5A, 5B are connected by spot welding. In this case, the inner layer thermoplastic elastomers 3A, 3B have been removed at the same end face as that of the outer layer thermoplastic elastomers 2A, 2B.

In this fourth embodiment, the end portions of the canvas are cut off, and a web-shaped overlap of the patch for reinforcing the canvases is inclined with the same overlap width, whereby a moving handrail ridge line, where a tensile deformation or a compression deformation applied to the moving handrail at the time of operation of the escalator becomes the maximum, and the overlap between the canvases of different elastic modulus are crossed over, which results in reduction in stress concentration. Consequently, the moving handrail connection portion can be improved in durability. Table 4 shows results of evaluating a splice angle dependency indicated by number of times of repetition in a bending test of the moving handrail according to this fourth embodiment. In addition, combination of construction of this fourth embodiment with those described in the foregoing first to third embodiments can provide a further improvement in durability.

TABLE 4

| Dependency indicated by number of repetition in the bending test upon a splice angle of the patch | | |
|---|---|---|
| Splice angle (degrees) | 90 | 60 |
| Number of repetition (times) | 50000 | Not less than 10000000 |

Embodiment 5

Figure 7:
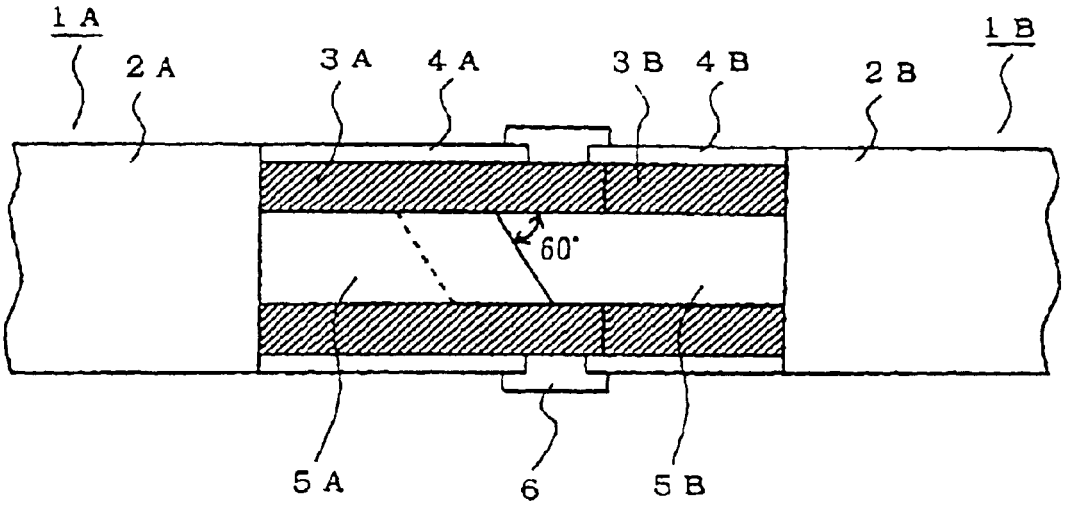
FIG. 7 is a cross sectional plan view showing a manufacturing process of a moving handrail for a passenger conveyor according to a fifth preferred embodiment of the invention.

FIG. 7 is a schematic view of a moving handrail end portion under manufacturing process to explain a fifth preferred embodiment of the invention. A connection procedure between the moving handrail end portions according to the fifth embodiment is described. First, the outer layer thermoplastic elastomers 2A, 2B are removed from the end portions 1A, 1B, and subsequently the inner layer thermoplastic elastomers 3A, 3B are removed at the upper side above the metal stretch inhibitors 5A, 5B to expose the metal stretch inhibitors 5A, 5B. The inner layer thermoplastic elastomers 3A, 3B have been cut off in such dimension that the metal stretch inhibitors 5A, 5B be overlapped when cutting-planes of the inner thermoplastic elastomers 3A, 3B are abutting.

Then, end portions of the canvas 4A, 4B are cut off so that cutting-plane line may be inclined at an angle of more than 0° to less than 90°, for example, at an angle of 60° with respect to a longitudinal direction. At these end portions 1A, 1B, as shown in FIG. 7, the metal stretch inhibitors 5A, 5B are overlapped and bonded together with the use of an adhesive in a state that the inner layer thermoplastic elastomers 3A, 3B are abutting. In this manner, the overlap between the metal stretch inhibitors 5A, 5B comes to be a web shape inclined at an angle of 60° with respect to a longitudinal direction. Further, a patch 6 is applied to the canvases 4A, 4B and adhesive-bonded. Finally, the end portions 1A, 1B of the moving handrail are placed in the mold, and molded with a thermoplastic elastomer by a publicly known method such as injection molding or press molding thereby completing an integral moving handrail belt. It is also preferable that the metal stretch inhibitors 5A, 5B are connected by spot welding. In this case, the inner layer thermoplastic elastomers 3A, 3B have been removed at the same end face as that of the outer layer thermoplastic elastomers 2A, 2B.

As described above, in the moving handrail for a passenger conveyor according to this fifth embodiment, a web-shaped overlap between the metal stretch inhibitors are inclined, whereby a moving handrail ridge line, where a tensile deformation or a compression deformation applied to the moving handrail at the time of operation of the escalator becomes the maximum, and the overlap between the metal stretch inhibitors of different elastic modulus are crossed over, which results in reduction in stress concentration. Consequently, the moving handrail connection portion can be improved in durability. Table 5 shows results of evaluating a splice angle dependency indicated by number of times of repetition in a bending test of the moving handrail according to this fifth embodiment. In addition, combination of construction of this fifth embodiment with those of the foregoing first to fourth embodiments can provide a further improvement in durability.

TABLE 5

| Dependency indicated by number of repetition in the bending test upon a splice angle of the metal stretch inhibitors | | |
|---|---|---|
| Splice angle (degrees) | 90 | 60 |
| Number of repetition (times) | 50000 | Not less than 10000000 |

Embodiment 6

Figure 8:
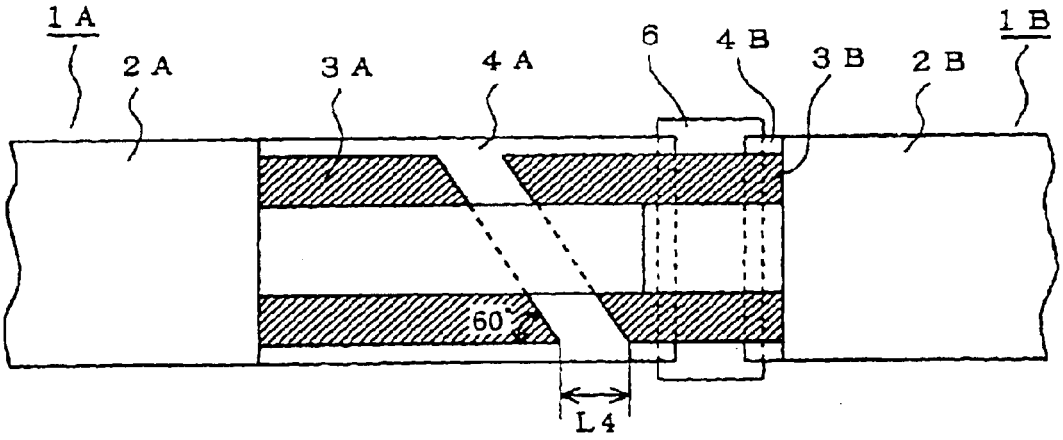
FIG. 8 is a cross sectional plan view showing a manufacturing process of a moving handrail for a passenger conveyor according to a sixth preferred embodiment of the invention.

FIG. 8 is a schematic view of a moving handrail end portion under manufacturing process to explain a sixth preferred embodiment of the invention. A connection procedure between the moving handrail end portions according to the sixth embodiment is described. First, the outer layer thermoplastic elastomers 2A, 2B are removed from the end portions 1A, 1B, and subsequently the inner layer thermoplastic elastomers 3A, 3B are removed at the upper side above the metal stretch inhibitors 5A, 5B to expose the metal stretch inhibitors 5A, 5B. Further, the inner layer thermoplastic elastomer 3A, 3B are cut off so that cutting-plane line thereof are inclined at, e.g., 60° with respect to a longitudinal direction.

Such end portions 1A, 1B are disposed, as shown in FIG. 8, so that the inclined end portions of the cut inner layer thermoplastic elastomer 3A, 3B may be opposed, with a gap L4 of not less than 1 mm, for example, 10 mm therebetween, and the metal stretch inhibitors 5A, 5B are adhesive-bonded in this state. Further, the patch 6 is overlapped on the canvases 4A, 4B so that an overlap width may be 10 mm, and bonded using an adhesive. Finally, the end portions 1A, 1B of the moving handrail are placed in the mold, and molded with a thermoplastic elastomer by a publicly known method such as injection molding or press molding there by completing an integral moving handrail belt.

In the moving handrail for a passenger conveyor according to this sixth embodiment, there is provided a gap of not less than 1 mm between connection end portions of the inner layer thermoplastic elastomers, which are connected by the outer layer thermoplastic elastomer, thereby reducing a stress concentration applied to a fusion interface between the outer layer thermoplastic elastomer and the inner layer thermoplastic elastomer, resulting in an advantage of improving durability. Table 6 shows results of evaluating a joint gap dependency indicated by number of times of repetition in a bending test of the moving handrail according to this sixth embodiment. In addition, combination of construction of this sixth embodiment with that of any of the foregoing first to fifth embodiments can provide a further improvement in durability.

TABLE 6

| Joint gap dependency indicated by number of repetition in the bending test | | |
|---|---|---|
| Joint gap (mm) | 0.5 | 10.0 |
| Number of repetition (times) | 25000 | Not less than 10000000 |

While the presently preferred embodiments of the present invention have been shown and described, it is tobe understood these disclosures are for the purpose of illustration and that various changes and modifications may be made without departing from the scope of the invention as set forth in the appended claims.

What is claimed is:

1. A moving handrail for a passenger conveyor including a linear belt of which two end portions are connected forming a loop of said linear belt, said linear belt including:

at least one layer of a thermoplastic elastomer having a C-shape in cross section;

metallic and web-shaped metal stretch inhibitors disposed along a longitudinal direction of said thermoplastic elastomer; and base members coupled inside of said thermoplastic elastomer, said thermoplastic elastomer, metal stretch inhibitor, and base member being integrally molded, wherein, at a connection portion forming the loop of said belt, a splice junction between said metal stretch inhibitors and a joint where said base members are connected together at end portions with an auxiliary backing, do not overlap in a direction of thickness of the moving handrail, and said metal stretch inhibitors are enclosed in a thermoplastic elastomer.

2. The moving handrail for a passenger conveyor according to claim 1, wherein both end portions of said metal stretch inhibitors of said connection portion are overlapped and spliced together so as to sandwich a buffer layer composed of both or either one of a thermoplastic resin sheet and a thermosetting rein sheet, otherwise via a buffer layer directly applied with a liquid resin, and said metal stretch inhibitors having been spliced are enclosed with a thermoplastic elastomer.

3. The moving handrail for a passenger conveyor according to claim 1, wherein:

said linear belt includes an inner layer thermoplastic elastomer having a C-shape in cross section and an outer layer thermoplastic elastomer having an elastic modulus different from said inner layer thermoplastic elastomer; and said connection portion forming the loop of said belt comprises a butt joint where ends of said inner layer thermoplastic elastomer abut along one of a straight line inclined at an angle of more than 0° and less than 90° with respect to the longitudinal direction, and a curved line.

4. The moving handrail for a passenger conveyor according to claim 1, wherein:

said linear belt includes an inner layer thermoplastic elastomer having a C-shape in cross section and an outer layer thermoplastic elastomer having an elastic modulus different from said inner layer thermoplastic elastomer; and a butt joint between ends of said inner layer thermoplastic elastomer includes a gap of not less than 1 mm.

5. A moving handrail for a passenger conveyor including a linear belt of which two end portions are connected forming a loop;

said linear belt being composed of: a single-layer or multilayer of thermoplastic elastomer of C-shape in cross section;

metallic and web-shaped metal stretch inhibitors disposed along a longitudinal direction of the thermoplastic elastomer; and base members coupled inside of said thermoplastic elastomer; said thermoplastic elastomer, metal stretch inhibitor and base member being integrally molded;

wherein said connection portion of said moving handrail for a passenger conveyor comprises: a splice junction between said metal stretch inhibitors; and a joint where both ends of the base member are formed into a straight line inclined at an angle of more than 0° to less than 90° with respect to a longitudinal direction or into a curved line and connected together with the use of an auxiliary backing overlapped therewith in the same overlapping width; and said splice junction between the metal stretch inhibitors is covered with the thermoplastic elastomer.

6. The moving handrail for a passenger conveyor according to claim 5, wherein both end portions of said metal stretch inhibitors of said connection portion are overlapped and spliced together so as to sandwich a buffer layer composed of both or either one of a thermoplastic resin sheet and a thermosetting rein sheet, otherwise via a buffer layer directly applied with a liquid resin, and said metal stretch inhibitors having been spliced are enclosed with a thermoplastic elastomer.

7. A moving handrail for a passenger conveyor including a linear belt of which two end portions are connected forming a loop of said linear belt, said linear belt including:

at least one layer of a thermoplastic elastomer having a C-shape in cross section;

metallic and web-shaped metal stretch inhibitors disposed along a longitudinal direction of said thermoplastic elastomer; and base members coupled inside of said thermoplastic elastomer; said thermoplastic elastomer, metal stretch inhibitor, and base member being integrally molded, wherein a connection portion of said moving handrail for a passenger conveyor comprises:

a splice junction where said metal stretch inhibitors are overlapped and spliced, both end portions having one of a straight line inclined at an angle of more than 0° and less than 90° with respect to the longitudinal direction and a curved line, overlapping with the same width; and a joint where the base members at both end portions are connected together with an auxiliary backing, and said splice junction between the metal stretch inhibitors is covered with the thermoplastic elastomer.

8. The moving handrail for a passenger conveyor according to claim 7, wherein both end portions of said metal stretch inhibitors of said connection portion are overlapped and spliced together so as to sandwich a buffer layer composed of both or either one of a thermoplastic resin sheet and a thermosetting rein sheet, otherwise via a buffer layer directly applied with a liquid resin, and said metal stretch inhibitors having been spliced are enclosed with a thermoplastic elastomer.

* * * * *